US011447722B2

(12) United States Patent
Piorkowski

(10) Patent No.: US 11,447,722 B2
(45) Date of Patent: Sep. 20, 2022

(54) DETERGENT COMPOSITION FOR TEXTILE SOFTENING AND ANTI-REDEPOSITION

(71) Applicant: Henkel AG & Co. KGaA, Duesseldorf (DE)

(72) Inventor: Daniel Thomas Piorkowski, Fairfield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 10 days.

(21) Appl. No.: 16/777,471

(22) Filed: Jan. 30, 2020

(65) Prior Publication Data

US 2021/0238500 A1 Aug. 5, 2021

(51) Int. Cl.

| | |
|---|---|
| ***C11D 17/04*** | (2006.01) |
| ***C11D 3/00*** | (2006.01) |
| ***C11D 3/37*** | (2006.01) |
| ***C11D 1/83*** | (2006.01) |
| ***C11D 1/14*** | (2006.01) |
| ***C11D 1/28*** | (2006.01) |

(Continued)

(52) U.S. Cl.

CPC ..... *C11D 1/83* (2013.01); *C11D 1/143* (2013.01); *C11D 1/28* (2013.01); *C11D 1/72* (2013.01); *C11D 3/001* (2013.01); *C11D 3/222* (2013.01); *C11D 3/3769* (2013.01); *C11D 17/043* (2013.01)

(58) Field of Classification Search

CPC ..... C11D 1/83; C11D 1/143

See application file for complete search history.

(56) References Cited

U.S. PATENT DOCUMENTS 5,880,076 A * 3/1999 Vermeer ..... C11D 3/0089 510/123

7,576,048 B2 8/2009 Gray et al.

(Continued)

FOREIGN PATENT DOCUMENTS

EP 2791310 A1 * 10/2014 ..... C11D 3/3769

EP 2982738 A1 2/2016

(Continued)

OTHER PUBLICATIONS

European Patent Office, European Search Report, EP 21 15 4222, dated Jun. 29, 2021, pp. 1-8, Munich, Germany.

*Primary Examiner* — Liam J Heincer
*Assistant Examiner* — M. Reza Asdjodi
(74) *Attorney, Agent, or Firm* — Bojuan Deng

(57) ABSTRACT

A detergent composition for improved textile softening and anti-redeposition includes a surfactant component, water, and a cationic polymer. The surfactant component includes (1) an alcohol ethoxy sulfate having a $C_8$-$C_{20}$ backbone that is ethoxylated with from about 1 to about 10 moles of ethylene oxide, (2) at least one non-ionic surfactant having an alkoxylated alcohol; and (3) at least one anionic surfactant having a linear alkylbenzene sulfonate. The surfactants (1), (2), and (3) are present in a weight ratio of actives of about (0 to 0.55):(0 to 0.55):(0.15 to 0.9), so long as at least two of (1), (2), and (3) are each present in an amount of greater than zero. Water is present in a total amount of from about 10 to about 85 weight percent while the cationic polymer is present in an amount of from about 0.05 to about 1 weight percent actives.

18 Claims, 4 Drawing Sheets

(51) Int. Cl.
*C11D 1/72* (2006.01)
*C11D 3/22* (2006.01)

(56) References Cited

U.S. PATENT DOCUMENTS

2005/0129643 A1* 6/2005 Lepilleur ..... A61Q 5/02 424/70.1
2006/0030513 A1 2/2006 Binder et al.
2006/0217287 A1 9/2006 Zhu et al.
2006/0223739 A1 10/2006 Zhu et al.
2007/0270324 A1* 11/2007 Bastigkeit ..... C11D 3/38618 510/386
2009/0137438 A1* 5/2009 Lepilleur ..... C08L 1/26 510/121
2016/0040105 A1* 2/2016 Depoot ..... C11D 17/043 510/296
2016/0060572 A1* 3/2016 Panandiker ..... C11D 3/3776 510/327
2018/0320109 A1* 11/2018 Boutique ..... C11D 3/43
2018/0334641 A1* 11/2018 Piorkowski ..... C11D 1/65
2019/0017001 A1* 1/2019 Camire ..... C11D 3/37
2019/0112563 A1* 4/2019 Piorkowski ..... C11D 3/382
2020/0199493 A1* 6/2020 Piorkowski ..... C11D 3/2086
2020/0199503 A1* 6/2020 Piorkowski ..... C11D 1/83
2021/0238500 A1* 8/2021 Piorkowski ..... C11D 3/001
2021/0238512 A1* 8/2021 Piorkowski ..... C11D 3/2068
2021/0277332 A1* 9/2021 Piorkowski ..... C11D 11/0017

FOREIGN PATENT DOCUMENTS

EP 2791310 B1 1/2017
EP 3074497 B1 5/2017
EP 3074495 B1 7/2017
EP 3074496 B1 7/2017
EP 2922936 B1 8/2019
WO 9823720 A1 6/1998
WO 2013087285 A1 6/2013
WO 2019166477 A1 9/2019

* cited by examiner

DETERGENT COMPOSITION FOR TEXTILE SOFTENING AND ANTI-REDEPOSITION

FIELD OF THE INVENTION

The present disclosure generally relates to a detergent composition for improved textile softening and excellent anti-redeposition. More specifically, the disclosure relates to inclusion of a particular combination of surfactants at particular weight ratios of actives along with a cationic polymer.

BACKGROUND OF THE INVENTION

It is well known in the art that "softening through the wash" laundry detergents have been available for years. These products provide cleaning as well as fabric care/softening simultaneously. Typically, these products do not perform as well as dedicated cleaning detergents or dedicated fabric softeners. However, they provide convenience and still provide good results.

These products typically use cationic polymers to soften clothing. These cationic polymers soften clothing via deposition on negatively charged textiles. In other words, there is an opposite charge attraction between the positively charged cationic polymer and the negatively charged textile. However, when fabrics are washed in the presence of clay (which is a standard anti-redeposition test), the cationic polymers can drive deposition of the clay to the textile, causing the textile to appear dingy and discolored. The clay is thought to be driven to the textile via a similar mechanism as the cationic polymer. Therefore, the same or a similar mechanism that allows the cationic polymer to successfully attach to the textile and provide softening negatively affects anti-redeposition because the clay is also attracted to the textile which produces negative results. Accordingly, there remains an opportunity for improvement. Furthermore, other desirable features and characteristics of the present disclosure will become apparent from the subsequent detailed description of the disclosure and the appended claims, taken in conjunction this background of the disclosure.

BRIEF SUMMARY OF THE INVENTION

This disclosure provides a detergent composition for improved textile softening and anti-redeposition. The composition includes a surfactant component, water, and a cationic polymer. The surfactant component includes (1) an alcohol ethoxy sulfate having a $C_8$-$C_{20}$ backbone that is ethoxylated with from about 1 to about 10 moles of ethylene oxide, (2) at least one non-ionic surfactant comprising an alkoxylated alcohol; and (3) at least one anionic surfactant comprising a linear alkylbenzene sulfonate. The surfactants (1), (2), and (3) are present in a weight ratio of actives of about (0 to 0.55):(0 to 0.55):(0.15 to 0.9), so long as at least two of (1), (2), and (3) are each present in an amount of greater than zero. Moreover, the water is present in a total amount of from about 10 to about 85 weight percent based on a total weight of the detergent composition. In addition, the cationic polymer is present in an amount of from about 0.05 to about 1 weight percent actives based on a total weight of the detergent composition.

This disclosure also provides a unit dose detergent wherein the surfactant component described above is present in an amount of from about 40 to about 50 weight percent based on a total weight of the detergent composition.

This disclosure also provides a unit dose detergent pack comprising a pouch made of a water-soluble film and the detergent composition described above that is encapsulated within the pouch.

This disclosure further provides a liquid laundry detergent wherein the surfactant component described above is present in an amount of from about 8 to about 20 weight percent based on a total weight of the detergent composition.

This disclosure also provides a method of washing a textile to provide improved cleaning, anti-deposition, and/or softening benefits in the presence of a clay, wherein the method includes the step of providing a textile optionally soiled with clay; providing water including a detergent composition and optionally clay; and washing the textile with the water and detergent composition, wherein at least one of the textile or the water comprises the clay, and wherein the detergent composition is as described above.

The detergent composition exhibits superior and unexpected results. More specifically, particular surfactant active weight ratios maximize the softening of the cationic polymer and simultaneously minimize redeposition of clay, which is shown to be statistically significant. This maximizes the performance of the detergent composition of the consumer. More specifically, unexpected algorithmic prediction expressions were generated which can further maximize softening and anti-redeposition embodiments.

BRIEF DESCRIPTION OF THE DRAWINGS

The present disclosure will hereinafter be described in conjunction with the following Figures, wherein.

DETAILED DESCRIPTION OF THE INVENTION

Figure 1:
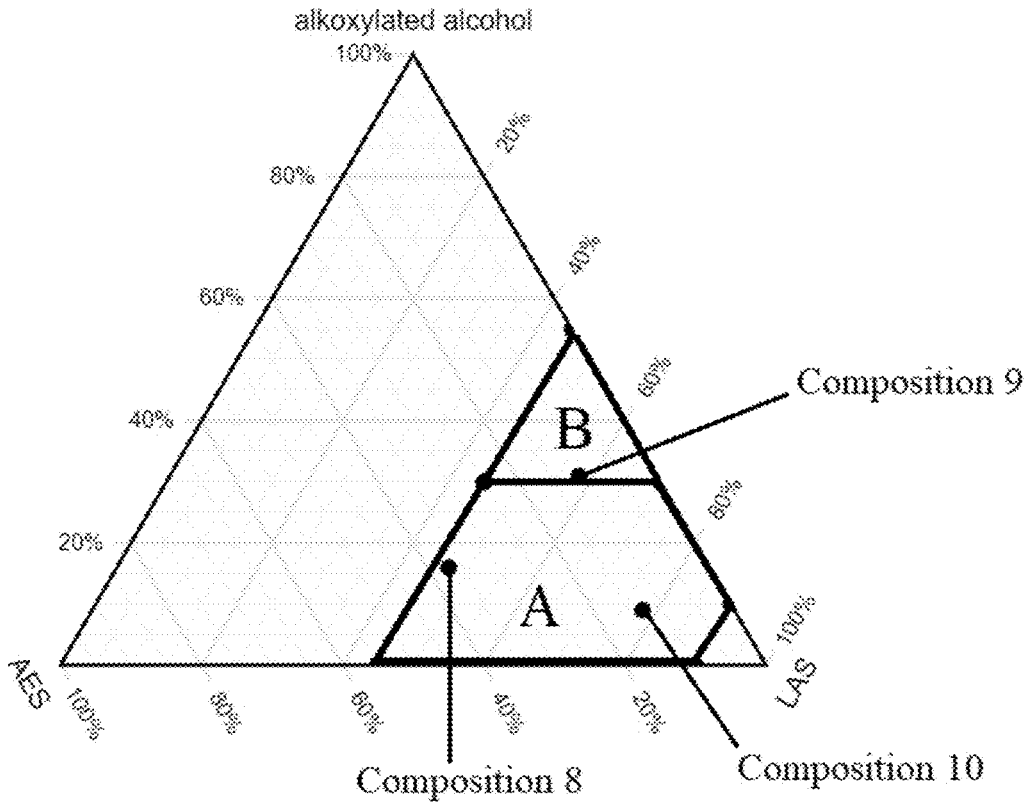
FIG. 1 is a ternary plot of weight ratios of actives of three surfactants of the surfactant component of the instant disclosure showing a five-sided region (A) and a three-sided region (B) that is further described in the Examples and which corresponds to various predictive algorithms generated in the Examples.

The following detailed description is merely exemplary in nature and is not intended to limit the disclosure. Furthermore, there is no intention to be bound by any theory presented in the preceding background or the following detailed description.

Embodiments of the present disclosure are generally directed to detergent compositions and methods for forming the same. For the sake of brevity, conventional techniques related to detergent compositions may not be described in detail herein. Moreover, the various tasks and process steps described herein may be incorporated into a more comprehensive procedure or process having additional steps or functionality not described in detail herein. In particular, various steps in the manufacture of detergent compositions are well-known and so, in the interest of brevity, many conventional steps will only be mentioned briefly herein or will be omitted entirely without providing the well-known process details.

In one aspect, the present disclosure provides a detergent composition with consistent softening and anti-redeposition properties. The detergent composition may comprise a particular surfactant composition, water, and a cationic polymer, as described in detail below. Of the components, the cationic polymer acts as a fabric softener. The detergent composition may be used in a unit dose pack detergent product or as a liquid laundry detergent product.

In another aspect, the present disclosure provides a method for maximizing fabric softening while simultaneously minimizing deposition of clay on a fabric. The method includes the step of providing a detergent composition that includes the aforementioned surfactant component, water, and cationic polymer. The method also includes the step of applying the detergent composition to a textile or fabric, which may be any known in the art.

It was unexpectedly discovered that, as a result of incorporating the particular surfactant component, the detergent composition shows a trend of being able to both simultaneously soften fabric while reducing deposition of dirt and clay on the same fabric.

Detergent Composition

This disclosure provides the detergent composition, first introduced above and hereinafter referred to as a composition. The composition may be, include, consist essentially of, or consist of, a surfactant component, water, and a cationic polymer, as each is described below, e.g. in any one or more of the amounts described in greater detail below.

In one embodiment, the composition comprises the surfactant component including the surfactant component, water, and the cationic polymer.

In another embodiment, the composition consists essentially of the surfactant component, water, and the cationic polymer.

In still another embodiment, the composition consists of the surfactant component, water, and the cationic polymer.

In yet another embodiment, the composition comprises the surfactant component, water, and the cationic polymer along with a non-ionic and/or anionic soil release polymer.

In another embodiment, the composition consists essentially of the surfactant component, water, and the cationic polymer along with a non-ionic and/or anionic soil release polymer.

In another embodiment, the composition consists of the surfactant component, water, and the cationic polymer along with a non-ionic and/or anionic soil release polymer.

In further embodiments, the composition is free of, or includes less than 1, 0.5, 0.1, 0.05, or 0.01, weight percent of, any one or more of the optional components or additives described above or below.

Surfactant Component

As first introduced above, the composition includes the surfactant component. The surfactant component includes, is, consists essentially of, or consists of, (1) an alcohol ethoxy sulfate having a $C_8$-$C_{20}$ backbone that is ethoxylated with from about 1 to about 10 moles of ethylene oxide, (2) at least one non-ionic surfactant comprising an alkoxylated alcohol; and (3) at least one anionic surfactant comprising a linear alkylbenzene sulfonate.

In one embodiment, the surfactant component includes (1) an alcohol ethoxy sulfate having a $C_8$-$C_{20}$ backbone that is ethoxylated with from about 1 to about 10 moles of ethylene oxide, (2) at least one non-ionic surfactant comprising an alkoxylated alcohol; and (3) at least one anionic surfactant comprising a linear alkylbenzene sulfonate.

In another embodiment, the surfactant component consists essentially of (1) an alcohol ethoxy sulfate having a $C_8$-$C_{20}$ backbone that is ethoxylated with from about 1 to about 10 moles of ethylene oxide, (2) at least one non-ionic surfactant comprising an alkoxylated alcohol; and (3) at least one anionic surfactant comprising a linear alkylbenzene sulfonate.

In a further embodiment, the surfactant component consists of (1) an alcohol ethoxy sulfate having a $C_8$-$C_{20}$ backbone that is ethoxylated with from about 1 to about 10 moles of ethylene oxide, (2) at least one non-ionic surfactant comprising an alkoxylated alcohol; and (3) at least one anionic surfactant comprising a linear alkylbenzene sulfonate.

The surfactants (1), (2), and (3) are present in a weight ratio of actives of about (0 to 0.55):(0 to 0.55):(0.15 to 0.9), so long as at least two of (1), (2), and (3) are each present in an amount of greater than zero. Accordingly, surfactant (1), which is the alcohol ethoxy sulfate may be present in an amount of the aforementioned ratio of about 0, 0.5, 0.1, 0.15, 0.2, 0.25, 0.3, 0.35, 0.4, 0.45, 0.5, or 0.55. Moreover, surfactant (2), which is the at least one non-ionic surfactant may be present in an amount of the aforementioned ratio of about 0, 0.5, 0.1, 0.15, 0.2, 0.25, 0.3, 0.35, 0.4, 0.45, 0.5, or 0.55. Furthermore, surfactant (3), which is the at least one anionic surfactant, may be present in an amount of the aforementioned ratio of about 0.15, 0.2, 0.25, 0.3, 0.35, 0.4, 0.45, 0.5, 0.55, 0.6, 0.65, 0.7, 0.75, 0.8, 0.85, or 0.9. In addition, at least two of surfactants (1), (2), and (3) must be present. This means that two of the surfactants cannot be present in an amount of zero. For example, the surfactant component includes surfactants (1), (2), and (3); or (1) and (2) without (3), or (1) and (3) without (2), or (2) and (3), without (1). In various non-limiting embodiments, all values, both whole and fractional, between and including all of the above, are hereby expressly contemplated for use herein.

In one embodiment, the weight ratio of actives of (1), (2), and (3) falls within a five-sided region (A) of a ternary plot as set forth in FIG. 1. This Figure shows a five-sided region (A) that is defined by five points of the ratio of (1):(2):(3) as follows:

(i) (0.55):(0):(0.45);
(ii) (0.25):(0.3):(0.45);
(iii) (0):(0.3):(0.7);
(iv) (0):(0.1):(0.9); and
(v) (0.1):(0):(0.9).

Notably the roman numerals (i), (ii), (iii), (iv), or (iv) do not specifically correspond to surfactants (1), (2), and (3).

In another embodiment, the weight ratio of actives of (1), (2), and (3) falls within a three-sided region (B) of a ternary plot as also set forth in FIG. 1. This Figure also shows the three-sided region (B) is defined by three points of the ratio of (1):(2):(3) as follows:

(vi) (0):(0.55):(0.45);
(vii) (0.25):(0.3):(0.45); and
(viii) (0):(0.3):(0.7).

Notably the roman numerals (vi), (vii), and (viii) do not specifically correspond to surfactants (1), (2), and (3).

In one embodiment, the weight ratio of actives of (1), (2), and (3) are: (0.40):(0.43):(0.18). In another embodiment, the weight ratio of actives of (1), (2), and (3) are: (0.16):(0.37):

(0.47). In another embodiment, the weight ratio of actives of (1), (2), and (3) are: (0.31):(0.11):(0.58). In another embodiment, the weight ratio of actives of (1), (2), and (3) are: (0.09):(0.13):(0.78). In another embodiment, the weight ratio of actives of (1), (2), and (3) are: (0.41):(0.24):(0.35). In another embodiment, the weight ratio of actives of (1), (2), and (3) are: (0):(0.45):(0.55). Each of these points is also shown in FIG. 1. It is contemplated that the weight ratios of the active of (1), (2), and (3) may fall anywhere within the ternary plot shown in FIG. 1 or anywhere within the five-sided figure or three-sided figure set forth in FIG. 1. In various non-limiting embodiments, all values, both whole and fractional, between and including all of the above, are hereby expressly contemplated for use herein.

The amount of the surfactant component itself in the composition is not particularly limited. In various embodiments, the surfactant component can be present in the composition in an amount of from about 5 to about 90, about 10 to about 85, about 15 to about 80, about 20 to about 75, about 25 to about 70, about 30 to about 65, about 35 to about 60, about 40 to about 55, about 45 to about 50, about 40 to about 50, or about 8 to about 20, weight percent actives based on a total weight of the composition. In various non-limiting embodiments, all values, both whole and fractional, between and including all of the above, are hereby expressly contemplated for use herein.

Alcohol Ether Sulfate

The surfactant component includes the (1) alcohol ethoxy sulfate, which may be described as an anionic surfactant. The alcohol ethoxy sulfate has a $C_8$-$C_{20}$ backbone that is ethoxylated with from about 1 to about 10 moles of ethylene oxide. Alternatively, the alcohol ethoxy sulfate may be described as having a $C_8$-$C_{20}$ backbone and about 1 to 10 moles of ethylene oxide units bonded thereto. The metal may be any metal but is typically sodium or potassium. The backbone of the surfactant component may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. Various mixtures of alcohol ethoxy sulfates may also be used wherein different length backbones are utilized. The backbone is ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide. In various non-limiting embodiments, all values, both whole and fractional, between and including all of the above, are hereby expressly contemplated for use herein.

In various embodiments, the alcohol ethoxy sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alcohol ethoxy sulfate is sodium laureth sulfate ethoxylated with about 2 to about 4 moles of ethylene oxide. In various non-limiting embodiments, all values, both whole and fractional, between and including all of the above, are hereby expressly contemplated for use herein.

At Least One Non-Ionic Surfactant Comprising an Alkoxylated Alcohol:

The surfactant component also includes the (2) at least one non-ionic surfactant that includes, is, consists essentially of, or consists of, an alkoxylated alcohol. The terminology "at least one" means that one or more than one non-ionic surfactant may be utilized herein.

In one embodiment, the non-ionic surfactant includes an alkoxylated alcohol.

In one embodiment, the non-ionic surfactant consists essentially of an alkoxylated alcohol.

In one embodiment, the non-ionic surfactant consists of, an alkoxylated alcohol.

The alkoxylated alcohol may be a $C_8$-$C_{20}$ alcohol that is capped with (or comprises) approximately 2 to 12 moles of an alkylene oxide. In other embodiments, the alkoxylated alcohol may be an alcohol alkoxylate that has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values, both whole and fractional, between and including all of the above, are hereby expressly contemplated for use herein.

At Least One Anionic Surfactant Comprising a Linear Alkylbenzene Sulfonate

The surfactant component also includes at least one anionic surfactant that includes, is, consists essentially of, or consists of, a linear alkylbenzene sulfonate (LAS). The terminology "at least one" means that one or more than one anionic surfactant may be utilized herein.

In one embodiment, the at least one anionic surfactant includes a linear alkylbenzene sulfonate (LAS).

In one embodiment, the at least one anionic surfactant consists essentially of a linear alkylbenzene sulfonate (LAS).

In one embodiment, the at least one anionic surfactant consists of a linear alkylbenzene sulfonate (LAS).

The linear alkylbenzene sulfonate may have a linear alkyl chain that has, e.g. 10 to 13 carbon atoms. These carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art. In various non-limiting embodiments, all values, both whole and fractional, between and including all of the above, are hereby expressly contemplated for use herein.

In one embodiment, the alcohol ethoxy sulfate is sodium laureth sulfate ethoxylated with about 2 to about 4 moles of ethylene oxide, the linear alkyl benzenesulfonate has a linear alkyl chain that has from about 10 to about 13 carbon atoms, and the alkoxylated alcohol is an ethoxylated alcohol comprising a $C_8$-$C_2$ backbone that is ethoxylated with from about 2 to about 12 moles of ethylene oxide.

In another embodiment, the (1) alcohol ethoxy sulfate is sodium laureth sulfate ethoxylated with about 2 to about 4 moles of ethylene oxide, the (2) alkoxylated alcohol is a C12-C15 alcohol ethoxylate that is capped with approximately 7 moles of ethylene oxide; and the (3) linear alkyl benzenesulfonate is 2-Phenyl Sulfonic Acid, and the weight ratio of actives of (1), (2), and (3) falls within a five-sided region (A) of a ternary plot, wherein the five-sided region (A) is defined by five points of the ratio of (1):(2):(3) as follows: (i) (0.55):(0):(0.45); (ii) (0.25):(0.3):(0.45); (iii) (0):(0.3):(0.7); (iv) (0):(0.1):(0.9); and (v)(0.1):(0):(0.9). In various non-limiting embodiments, all values, both whole and fractional, between and including all of the above within the five-sided region, are hereby expressly contemplated for use herein.

In a further embodiment, the (1) alcohol ethoxy sulfate is sodium laureth sulfate ethoxylated with about 2 to about 4 moles of ethylene oxide, the (2) alkoxylated alcohol is a C12-C15 alcohol ethoxylate that is capped with approximately 7 moles of ethylene oxide; and the (3) linear alkyl benzenesulfonate is 2-Phenyl Sulfonic Acid, and the weight ratio of actives of (1), (2), and (3) falls within a three-sided region (B) of a ternary plot, wherein the three-sided region (A) is defined by three points of the ratio of (1):(2):(3) as follows: (vi) (0):(0.55):(0.45); (vii) (0.25):(0.3):(0.45); and (viii) (0):(0.3):(0.7). In various non-limiting embodiments, all values, both whole and fractional, between and including all of the above within the three-sided region, are hereby expressly contemplated for use herein.

Additional Surfactants

In other embodiments, one or more additional surfactants may be utilized and may be or include cationic, anionic, non-ionic, and/or zwitterionic surfactants, and/or combinations thereof. Additional anionic surfactants may include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters. In various non-limiting embodiments, all values, both whole and fractional, between and including all of the above, are hereby expressly contemplated for use herein.

Other suitable examples of additional nonionic surfactants include alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values, both whole and fractional, between and including all of the above, are hereby expressly contemplated for use herein.

In other embodiments, the additional surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In various non-limiting embodiments, all values, both whole and fractional, between and including all of the above, are hereby expressly contemplated for use herein.

The one or more additional surfactants may be part of the surfactant component, as described above, or may be independent from the surfactant component. In various embodiments, the one or more additional surfactants is or includes an additional anionic surfactant and/or a non-ionic surfactant. However, other surfactants such as cationic and/or zwitterionic (amphoteric) surfactants may also be utilized or may be excluded from the composition.

Water:

The detergent composition also includes water. Water is present in the composition in a total amount of from about 10 to about 85 weight percent based on a total weight of the composition. In various embodiments, the water is present in an amount of from about 15 to about 80, about 20 to about 75, about 25 to about 70, about 30 to about 65, about 35 to about 60, about 40 to about 55, about 45 to about 50, about 10 to about 20, or about 20 to about 85, weight percent based on a total weight of the composition. Typically, the terminology "total amount" refers to a total amount of water present in the composition from all components, i.e., not simply water added independently from, for example, the surfactant component and/or the tertiary amine. In various non-limiting embodiments, all values, both whole and fractional, between and including all of the above, are hereby expressly contemplated for use herein.

An independent source of water, such as DI water, may be used to dilute the composition. This water may be independent from any water present in the composition as originating from one or more components. In other words, the composition includes water originating from the components themselves. However, to further dilute the composition, the independent water source may be used.

Cationic Polymer:

The composition also includes the cationic polymer which is present in an amount of from about 0.05 to about 1, weight percent actives based on a total weight of the detergent composition. In various embodiments, the cationic polymer is present in an amount of from about 0.1 to about 0.9, about 0.2 to about 0.8, about 0.3 to about 0.7, about 0.4 to about 0.6, about 0.4 to about 0.5, about 0.05 to about 0.1, about 0.05 to about 0.75, or about 0.75 to about 0.1, weight percent actives based on a total weight of the detergent composition. In various non-limiting embodiments, all values, both whole and fractional, between and including all of the above, are hereby expressly contemplated for use herein.

The cationic polymer is not particularly limited and may be any known in the art. In various embodiments, the cationic polymer is chosen from polydiallyldimethylammonium chloride/acrylamide copolymers, a copolymer of ((2-methacryloyloxy)ethyl)-trimethyl ammonium chloride, cationic cellulosic polymers, and combinations thereof. In another embodiment, the cationic polymer is a cationic cellulosic polymer.

It is further contemplated that the composition can include non-ionic and/or anionic soil release polymer, which may be any known in the art. This non-ionic and/or anionic soil release polymer may be included in any amount listed above wherein the amount is in conjunction with, or independent from, the amount of the cationic polymer.

Non-Aqueous Solvent

In some embodiments, the composition may include, or may be free of, a non-aqueous solvent. In various embodiments, the non-aqueous solvent is present in an amount of from about 1 to about 30, about 3 to about 30, about 5 to about 30, about 10 to about 25, or about 15 to about 20, weight percent based on a total weight of the composition. In various non-limiting embodiments, all values, both whole and fractional, between and including all of the above, are hereby expressly contemplated for use herein.

The non-aqueous solvent is not particularly limited and may be any known in the art. In various embodiments, the non-aqueous solvent is chosen from glycerol (glycerin), propylene glycol, ethylene glycol, ethanol, and 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; tetramethylene glycol; butylene glycol; pentanediol; hexylene glycol; heptylene glycol; octylene glycol; 2-methyl, 1,3 propanediol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids. In other embodiments, the non-aqueous solvent is a relatively low molecular weight polyethylene glycol (PEG) having a weight average molecular weight of less than about 600 Da, e.g. about 400, such as those having a weight average molecular weight of from about 380 to about 420, Da. In other embodiments, PEG 200, PEG 250, PEG 300, PEG 350, PEG 400, PEG 450, PEG 500, PEG 550, and/or PEG 600 (wherein the numerals represent the approximate weight average molecular weight in Daltons) may be used. Other suitable non-aqueous solvents include ethylene oxide/propylene oxide block copolymers. In various non-limiting embodiments, all values, both whole and fractional, between and including all of the above, are hereby expressly contemplated for use herein.

In other embodiments, the composition is free of the non-aqueous solvent.

Additives:

The composition may include one or more of the following additives or may be free of one or more of the following additives. For example, the composition may include one or more foam inhibitors (e.g. defoaming agents). Suitable foam inhibitors include, but are not limited to, fatty acids such as coconut fatty acids. The composition may include the foam inhibitor at an amount of from about 0 to about 10 weight percent, based on the total weight of the composition. In various non-limiting embodiments, all values, both whole and fractional, between and including all of the above, are hereby expressly contemplated for use herein.

Bittering agents may optionally be added to hinder accidental ingestion of the composition. Bittering agents are compositions that taste bad, so children or others are discouraged from accidental ingestion. Exemplary bittering agents include denatonium benzoate, aloin, and others. Bittering agents may be present in the composition at an amount of from about 0 to about 1 weight percent, or an amount of from about 0 to about 0.5 weight percent, or an amount of from about 0 to about 0.1 weight percent in various embodiments, based on the total weight of the composition. In various non-limiting embodiments, all values, both whole and fractional, between and including all of the above, are hereby expressly contemplated for use herein.

In other embodiments, additives may be or include neutralizers/pH adjustors just as monoethanolamine and the like, enzymes, optical brighteners, chelators, and combinations thereof. These additives may be chosen from any known in the art.

In one embodiment, the composition is free of, or includes less than 5, 4, 3, 2, 1, 0.5, or 0.1, weight percent of, a solvent other than water, e.g. any organic solvent, non-polar solvent, polar aprotic solvent, polar protic solvent, etc. and combinations thereof. In another embodiment, the composition is free of, or includes less than 5, 4, 3, 2, 1, 0.5, or 0.1, weight percent of, propylene glycol and/or glycerine. In various non-limiting embodiments, all values, both whole and fractional, between and including all of the above, are hereby expressly contemplated for use herein.

Weight Percents/Ratios of Various Components:

The surfactant component, water, and cationic polymer are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below, in various non-limiting embodiments, all values, both whole and fractional, between and including all of the above, are hereby expressly contemplated for use herein.

In various embodiments, predictive expressions, as set forth below, can be used to predict the softness and anti-redeposition values for any ratio of surfactants.

For example, in one embodiment, the following predictive expression can be used for anti-redeposition values:

$$5.2088806607872*AES+6.32256602885479*NI+3.21160185393184*LAS$$

wherein LAS is linear alkylbenzene sulfonate, NI is the C12-C15 Alcohol Ethoxylate, and AES is the alcohol ethoxy sulfate. As shown in the Examples, the predictive expression shows that the linear alkylbenzene sulfonate impacts anti-redeposition the least (which is preferred) and almost has half the impact of the C12-C15 Alcohol Ethoxylate and the alcohol ethoxy sulfate.

In another embodiment, the following predictive expression can be used for softness values:

$$90.5185643647369*AES+89.6694175109953*NI+904809517493726*LAS$$

wherein LAS is linear alkylbenzene sulfonate, NI is the C12-C15 Alcohol Ethoxylate, and AES is the alcohol ethoxy sulfate. As shown in the Examples, the predictive expression shows that the linear alkylbenzene sulfonate and the alcohol ethoxy sulfate have the best effect of softening (higher score is preferred). The C12-C15 Alcohol Ethoxylate had the worst impact on softening performance.

In various embodiments, predictive expressions, as set forth below, can be used to predict the softness and anti-redeposition values for any ratio of surfactants.

For example, in one embodiment, the following predictive expression can be used for anti-redeposition values:

$$759327975555024*NI+3.68944473855553*AES+5.09799576797941*LAS$$

wherein LAS is linear alkylbenzene sulfonate, NI is the C12-C15 Alcohol Ethoxylate, and AES is the alcohol ethoxy sulfate. As shown in the Examples, the predictive expression shows the C12-C15 Alcohol Ethoxylate has the worst impact on anti-redeposition performance vs. the alcohol ethoxy sulfate/linear alkylbenzene sulfonate.

In another embodiment, the following predictive expression can be used for softness values:

$$87.8958361580214*NI+89.2673933985843*AES+89.138454580014*LAS$$

wherein LAS is linear alkylbenzene sulfonate, NI is the C12-C15 Alcohol Ethoxylate, and AES is the alcohol ethoxy sulfate. As shown in the Examples, the predictive expression shows the linear alkylbenzene sulfonate and the alcohol ethoxy sulfate have the best effect of softening (higher score is preferred). The C12-C15 Alcohol Ethoxylate had the worst impact on softening performance.

Physical Properties:

Typically, the compositions of this disclosure exhibit both softness and minimized redeposition simultaneously. Although quantifying these values can be difficult and can depend on the specific conditions used during the tests, various examples of softness and redeposition values are set forth below in the example.

For example, a textile such as a Cotton 460 textile may be washed and machine dried 3 times using, for example, a 24 gram dose of the composition in each wash, in a standard toploader washer with 120 ppm hardness water, 0 ppm chlorine, and 90° F. temperature and 6 pounds of ballast. The textiles can be dried for 60 minutes in a standard machine dryer. Subsequently, each sample can be evaluated to determine fabric softening using a phabrometer, such as a Phabrometer 3, 16500 R110, 5/12/2011 that is pre-programed with software. The values can be, for example, greater than about 89, 89.1, 89.2, 89.3, 89.4, 89.5, 89.6, 89.7, 89.8, 89.9, 90, etc. up to about 100, as understood by those of skill in the art. In various non-limiting embodiments, all values, both whole and fractional, between and including all of the above, are hereby expressly contemplated for use herein.

In other embodiments, and for example, to determine anti-redeposition, 5 grams of Red Clay can be added to each wash above. These washes are independent from the aforementioned washes used to determine fabric softening. Again, samples of the textiles can be washed except that Cotton 428 textiles can be used. The textiles can then be machine washed 3 times (24 gram dose each wash) in a standard toploader washer with 120 ppm hardness water, 0 ppm chlorine, and 90° F. temperature and 6 pounds of ballast. Fabrics were dried for 60 minutes in a standard machine dryer. Subsequently, each sample can be evaluated to determine anti-redeposition of the red clay using a colorimeter, such as an X-rite Ci 7860 instrument with Color iControl Program. These washed fabrics were compared against an unwashed fabric. Subsequently, delta E CMC values can then be calculated for each sample vs. the unwashed fabric, wherein a higher delta E CMC represents a worse performing sample. In various embodiments, the values can be less than about 6, 5.9, 5.8, 5.7, 5.6, 5.5, 5.4, 5.3, 5.2, 5.1, 5, 4.9, 4.8, 4.7, 4.6, 4.5, 4.4, 4.3, 4.2, 4.1, 4, etc. down to about 0.1. In various non-limiting embodiments, all values, both whole and fractional, between and including all of the above, are hereby expressly contemplated for use herein.

Method of Forming the Detergent Composition:

This disclosure further provides a method of forming the detergent composition. The method includes the step of combining the surfactant component, water, and the cationic polymer and optionally any additional solvents, surfactants, additives, etc., to form the detergent composition. Each of the aforementioned components may be combined in any order and in whole or partial amounts. All orders of addition are hereby expressly contemplated for use in various non-limiting embodiments.

Liquid Laundry Embodiment and Unit Dose Embodiment

This disclosure also provides a liquid laundry embodiment. For example, the composition may include amounts of water and/or any of the other components suitable for a liquid laundry application, as understood by those of skill in the art. For example, a liquid laundry detergent may include the surfactant component described above that is present in an amount of from about 8 to about 20 weight percent based on a total weight of the detergent composition.

This disclosure also provides a unit dose embodiment. For example, the composition may include amounts of water and/or any of the other components suitable for a unit dose application, as understood by those of skill in the art. For example, a unit dose detergent may include the surfactant component described above that is present in an amount of from about 40 to about 50 weight percent based on a total weight of the detergent composition.

Unit Dose Pack:

This disclosure provides a unit dose pack that includes a pouch made of a water-soluble film and the detergent composition encapsulated within the pouch.

A unit dose pack can be formed by encapsulating the detergent composition within the pouch, wherein the pouch includes a film. In some embodiments, the film forms one half or more of the pouch, where the pouch may also include dyes or other components. In some embodiments, the film is water soluble such that the film will completely dissolve when an exterior of the film is exposed to water, such as in a washing machine typically used for laundry. When the film dissolves, the pouch is ruptured and the contents are released. As used herein, "water soluble" means at least 2 grams of the solute (the film in one example) will dissolve in 5 liters of solvent (water in one example,) for a solubility of at least 0.4 grams per liter (g/l), at a temperature of 25 degrees Celsius (° C.) unless otherwise specified. Suitable films for packaging are completely soluble in water at temperatures of about 5° C. or greater.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide. In various non-limiting embodiments, all values, both whole and fractional, between and including all of the above, are hereby expressly contemplated for use herein.

The unit dose pack may be formed from a pouch having a single section, but the unit dose pack may be formed from pouches with two or more different sections in alternate embodiments. In embodiments with a pouch having two or more sections, the contents of the different sections may or may not be the same.

Method of Forming Unit Dose Pack:

This disclosure also provides a method of forming the unit dose pack. The composition is typically first formed, e.g. using shear mixing. Shear mixing may be conducted using an over-the-head mixer such as an IKA RW 20 Digital Mixer at 500 rpm. The composition may then be encapsulated within a pouch by depositing the composition within the pouch. The pouch may then be sealed to encase and enclose the composition within the pouch to form the unit dose pack. The composition is typically in direct contact with the film of the pouch within the unit dose pack. The film of the pouch is typically sealable by heat, heat and water, ultrasonic methods, or other techniques, and one or more sealing techniques may be used to enclose the composition within the pouch.

ADDITIONAL EMBODIMENTS

When fabrics are washed in the presence of clay such as in industry standard anti-redeposition tests, cationic polymers can drive deposition of the clay to the textile, causing the textile to appear dingy and discolored. However, various embodiments of the instant disclosure unexpectedly minimize the redeposition of clay.

This disclosure also provides a method of washing a textile to provide improved cleaning, anti-deposition, and/or softening benefits in the presence of a clay, wherein the method comprises the step of providing a textile optionally soiled with clay; providing water comprising a detergent composition and optionally clay; and washing the textile with the water and detergent composition, wherein at least one of the textile or the water comprises the clay, and wherein the detergent composition is as described above. This method may be alternatively described as a method of washing a textile using the detergent composition to provide cleaning, anti-deposition, and/or softening benefits in the presence of a clay. The clay may be any type of clay known in the art, any used in laundry detergent testing, or any described herein.

In another embodiment, this disclosure provides a method of washing a textile soiled with clay using the detergent composition to provide cleaning, anti-deposition, and/or softening benefits. In a further embodiment, this disclosure provides a method of washing a textile using the detergent composition to limit the redeposition of clay.

In various embodiments, one or more of these methods includes the step of washing the textile, drying the textile, and subsequently evaluating the textile to determine cleaning, anti-redeposition, and/or softening properties. These evaluations may be completed using any method or standard known in the art.

For example, any one of the methods may be further defined as including the step of washing a textile and subsequently drying the textile e.g. using a consumer or commercial drying machine. Subsequently, the textile can be evaluated to determine anti-redeposition of the clay, e.g. by using a colorimeter such as an X-rite Ci 7860 instrument with Color iControl Program. Washed textiles can then be compared against unwashed textiles. Moreover, delta E CMC values can then be calculated, wherein a higher delta E CMC represents a worse performing composition.

In other embodiments, any one of the methods may be further defined as including the step of washing a textile to soften the textile. For example, the method may include the step of washing a textile followed by the step of drying the textile, e.g. using a consumer or commercial drying machine. Subsequently, the textile can be evaluated to determine softness, e.g. by using a phabrometer, such as a Phabrometer 3 16500 R1110, 5/12/2011 that is pre-programed with software wherein a higher phabrometer value represents a better performing composition.

In still other embodiments, any one or more of these methods may include utilizing an algorithm, such as any one described herein to determine types and amounts of components used to achieve improved cleaning, anti-deposition, and/or softening benefits. For example, the method may include the step of utilizing a computer or processor to determine the types and/or amounts of the desired components.

EXAMPLES

Example 1

The following Design of Experiment was used to measure the effect of particular surfactants on the deposition of a cationic polymer for softening (i.e., Supracare 241) in a Unit Dose detergent formula. More specifically, the following compositions were formed and evaluated.

Table 1 below sets forth ratios of active levels of various surfactants of six compositions, i.e., Compositions 1-6. These correspond to the ternary plot of FIG. 2.

TABLE 1

| Composition | Alcohol Ethoxy Sulfate | C12-C15 Alcohol Ethoxylate | Linear Alkylbenzene Sulfonate |
|---|---|---|---|
| Composition 1 | 0.46883 | 0.18352 | 0.34765 |
| Composition 2 | 0.17115 | 0.18143 | 0.64742 |
| Composition 3 | 0.69312 | 0.20359 | 0.10329 |
| Composition 4 | 0.28976 | 0.53222 | 0.17803 |
| Composition 5 | 0.10769 | 0.76494 | 0.12737 |
| Composition 6 | 0.08024 | 0.48239 | 0.43737 |

The C12-C15 Alcohol Ethoxylate is a C12-C15 Alcohol Ethoxylate that is capped with approximately 7 moles of ethylene oxide.

Linear Alkylbenzene Sulfonate is 2-Phenyl Sulfonic Acid.

Alcohol Ethoxy Sulfate is Linear Alkylbenzene Sulfonate.

Table 2 below sets forth additional components of the Compositions 1-6, i.e., the completed Compositions wherein all values are in weight percent.

TABLE 2

| | Comp. 1 | Comp. 2 | Comp. 3 | Comp. 4 | Comp. 5 | Comp. 6 |
|---|---|---|---|---|---|---|
| C12-C15 Alcohol Ethoxylate | 7.34 | 7.26 | 8.14 | 21.29 | 30.60 | 19.30 |
| Linear Alkylbenzene Sulfonate | 13.91 | 25.90 | 4.13 | 7.12 | 5.09 | 17.49 |

TABLE 2-continued

| | Comp. 1 | Comp. 2 | Comp. 3 | Comp. 4 | Comp. 5 | Comp. 6 |
|---|---|---|---|---|---|---|
| Coconut Oil Fatty Acid | 4.00 | 4.00 | 4.00 | 4.00 | 4.00 | 4.00 |
| Monoethanolamine | 3.24 | 5.40 | 1.48 | 2.02 | 1.66 | 3.89 |
| Alcohol Ethoxy Sulfate (60% Active) | 31.26 | 11.41 | 46.21 | 19.32 | 7.18 | 5.35 |
| PEG 400 | 15.00 | 15.00 | 15.00 | 15.00 | 15.00 | 15.00 |
| Water | 24.65 | 30.43 | 20.43 | 30.65 | 35.87 | 34.37 |
| Supracare 241 | 0.60 | 0.60 | 0.60 | 0.60 | 0.60 | 0.60 |
| Total | 100.00 | 100.00 | 100.00 | 100.00 | 100.00 | 100.00 |

Supracare 241 is a cationic polymer used for fabric softening that is commercially available from Dow Chemical Corporation.

After formation, the Compositions 1-6 were used to machine wash Cotton 460 textiles. More specifically, samples of the textiles were washed and machine dried 3 times (24 gram dose each wash) in a standard toploader washer with 120 ppm hardness water, 0 ppm chlorine, and 90° F. temperature and 6 pounds of ballast. Fabrics were dried for 60 minutes in a standard machine dryer. Subsequently, each sample was evaluated to determine fabric softening using a Phabrometer 3, 16500 R1110, 5/12/2011 that is pre-programed with software. Values were determined after the third wash wherein a higher phabrometer value represents a better performing sample. The results are set forth in Table 3 below.

To determine anti-redeposition, 5 grams of Red Clay was added to each wash. These washes were independent from the aforementioned washes used to determine fabric softening. Again, samples of the textiles were washed except that Cotton 428 textiles were used. The textiles were then machine washed 3 times (24 gram dose each wash) in a standard toploader washer with 120 ppm hardness water, 0 ppm chlorine, and 90° F. temperature and 6 pounds of ballast. Fabrics were for a60 minutes in a standard machine dryer. Subsequently, each sample was evaluated to determine anti-redeposition of the red clay using a colorimeter such as an X-rite Ci 7860 instrument with Color iControl Program. Values were determined after the third wash. These washed fabrics were compared against an unwashed fabric. The delta E CMC values were then calculated for each sample vs. the unwashed fabric, wherein a higher delta E CMC represents a worse performing sample. The results are also set forth in Table 3 below. Each score is an average of 4 measurements on each fabric, for a total of 12 measurements on 3 different fabrics (that were washed together as triplicates within the same washing machine).

TABLE 3

| Composition | Delta E CMC for Anti-Redeposition Test After Wash 3 | Phabrometer Softening Score After Wash 3 |
|---|---|---|
| Composition 1 | 4.95 | 90.3495 |
| | 5.31 | 90.4013 |
| | 5.41 | 90.5325 |
| Average | 5.22 | 90.4278 |
| Composition 2 | 3.53 | 90.5051 |
| | 3.25 | 90.5756 |
| | 3.14 | 90.8538 |

TABLE 3-continued

| Composition | Delta E CMC for Anti-Redeposition Test After Wash 3 | Phabrometer Softening Score After Wash 3 |
|---|---|---|
| Average | 3.31 | 90.6448 |
| Composition 3 | 4.66 | 90.1732 |
| | 4.74 | 90.0709 |
| | 4.75 | 90.4314 |
| Average | 4.72 | 90.2252 |
| Composition 4 | 5.30 | 90.8444 |
| | 5.60 | 90.9405 |
| | 5.50 | 90.8929 |
| Average | 5.47 | 90.8926 |
| Composition 5 | 5.44 | 89.9303 |
| | 5.22 | 89.7751 |
| | 5.84 | 90.1164 |
| Average | 5.50 | 89.9406 |
| Composition 6 | 5.41 | 89.6343 |
| | 5.66 | 89.4596 |
| | 5.35 | 89.7068 |
| Average | 5.47 | 89.6002 |

Using JMP statistical software, a predictive expression was then determined to predict the softness and anti-redeposition values for any ratio of surfactants.

The following predictive expression was created for anti-redeposition values:

$$5.2088806607872*AES+6.32256602885479*NI+3.21160185393184*LAS$$

wherein LAS is linear alkylbenzene sulfonate, NI is the C12-C15 Alcohol Ethoxylate, and AES is the alcohol ethoxy sulfate. The predictive expression shows that the linear alkylbenzene sulfonate impacts anti-redeposition the least (which is preferred) and almost has half the impact of the C12-C15 Alcohol Ethoxylate and the alcohol ethoxy sulfate.

The following predictive expression was created for softness values:

$$90.8185643647369*AES+89.6694175109953*NI+90.4809517493726*LAS$$

wherein LAS is linear alkylbenzene sulfonate, NI is the C12-C15 Alcohol Ethoxylate, and AES is the alcohol ethoxy sulfate. The predictive expression shows that the linear alkylbenzene sulfonate and the alcohol ethoxy sulfate have the best effect of softening (higher score is preferred). The C12-C15 Alcohol Ethoxylate had the worst impact on softening performance.

Figure 3:
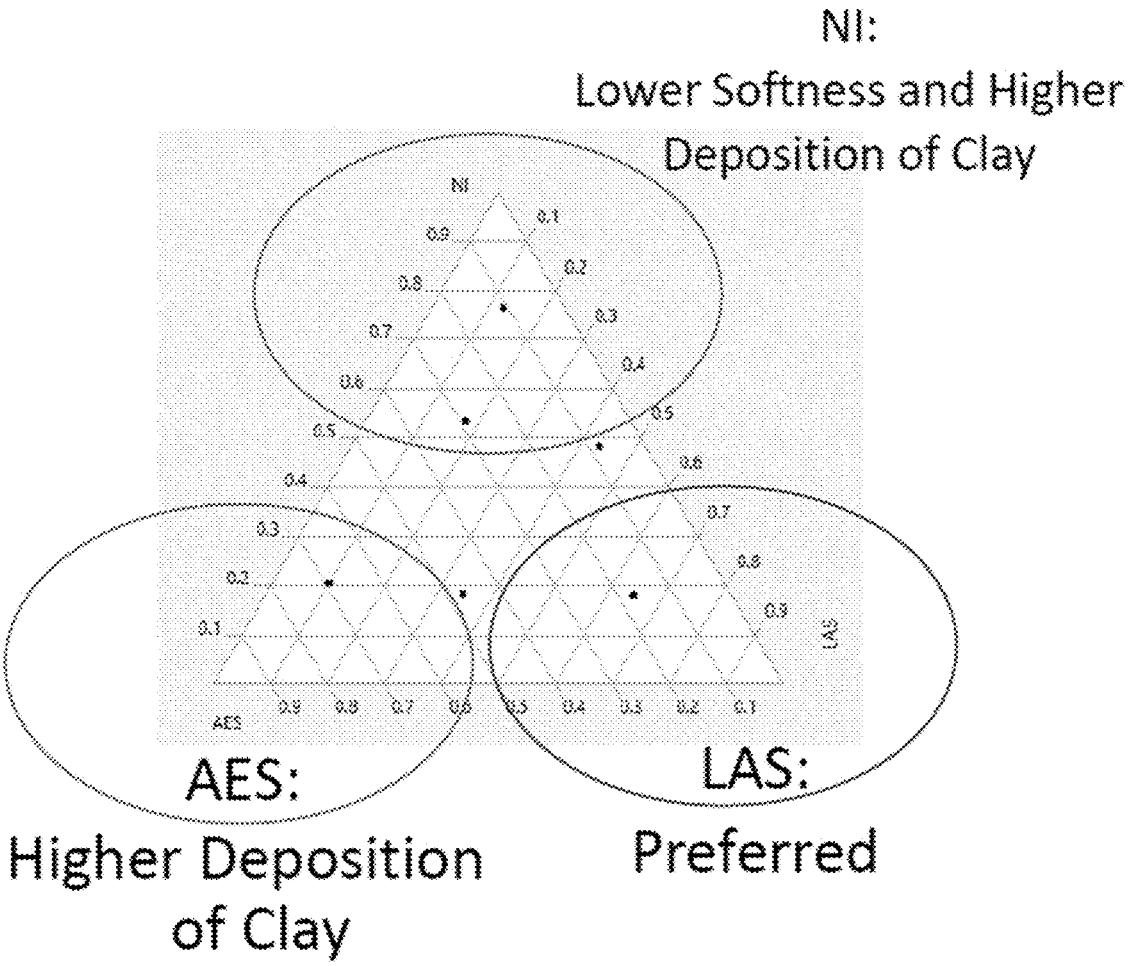
FIG. 3 is a ternary plot of weight ratios of actives of three surfactants of the surfactant component of the instant disclosure as also described in the Examples and represents a general summary of the results of Example 1.

A general summary was created from the results of Example 1 and is set forth in FIG. 3.

Example 2

Figure 2:
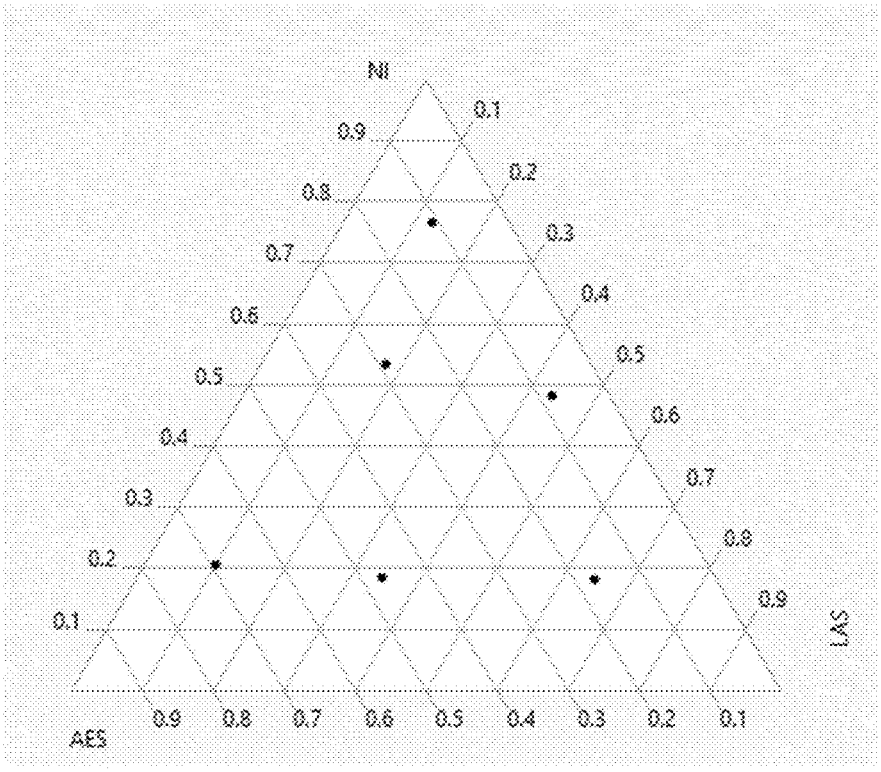
FIG. 2 is a ternary plot of weight ratios of actives of three surfactants of the surfactant component of the instant disclosure as described in the Examples corresponding to the weight ratios of actives set forth in Table 1 relative to Compositions 1-6.
Figure 4:
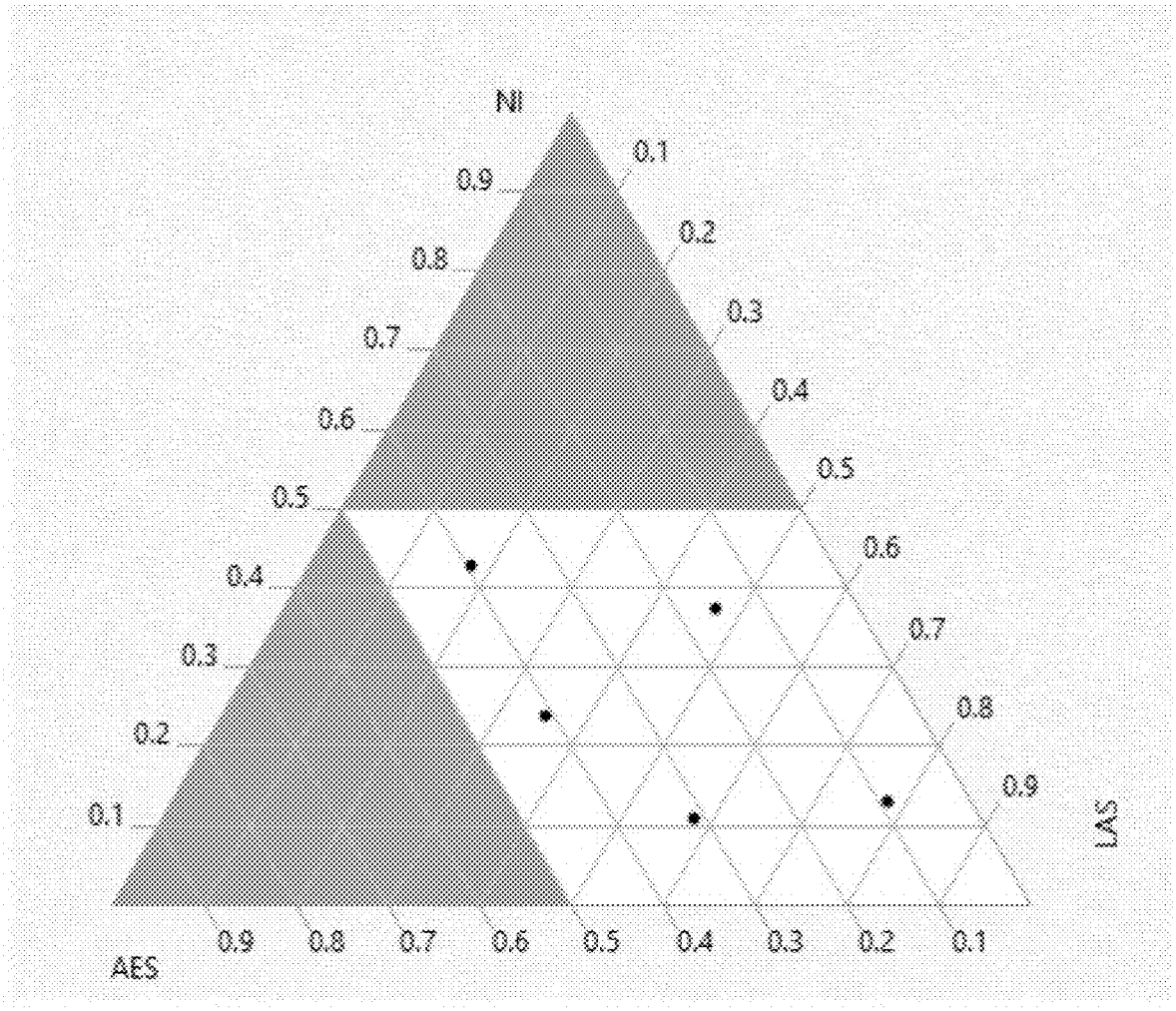
FIG. 4 is a ternary plot of weight ratios of actives of three surfactants of the surfactant component of the instant disclosure as further described in the Examples, i.e. Compositions 7-13, wherein particular alcohol ethoxy sulfate and C12-C15 alcohol ethoxylate regions of the ternary plot of FIG. 2 were removed and are shown as shaded sections.

Based on the results of Example 1, the following Design of Experiment was created for a liquid laundry detergent system, wherein particular alcohol ethoxy sulfate and C12-C15 alcohol ethoxylate regions of the ternary plot of FIG. 2 were removed from consideration based on their poor performance in Example 1. These removed sections are shown in the ternary plot of FIG. 4 as shaded. 12% active surfactant was used along with 0.35 wt % of Supracare 241. A 55.7 gram dose was also used.

Table 4 below sets forth the ratios of active levels of various components of the Compositions 7-13. These correspond to the ternary plot of FIG. 4.

TABLE 4

| Composition | Alcohol Ethoxy Sulfate | C12-C15 Alcohol Ethoxylate | Linear Alkylbenzene Sulfonate |
|---|---|---|---|
| Composition 7 | 0.40 | 0.43 | 0.18 |
| Composition 8 | 0.16 | 0.37 | 0.47 |
| Composition 9 | 0.31 | 0.11 | 0.58 |
| Composition 10 | 0.09 | 0.13 | 0.78 |
| Composition 11 | 0.41 | 0.24 | 0.35 |
| Composition 12 | 0.00 | 0.45 | 0.55 |
| Composition 13 | 0.54 | 0.32 | 0.14 |

Table 5 below sets forth additional components of the Compositions 7-11, i.e., the completed Compositions, wherein all values are in weight percent. Compositions 12 and 13 are described in greater detail further below.

TABLE 5

| | Comp. 7 | Comp. 8 | Comp. 9 | Comp. 10 | Comp. 11 |
|---|---|---|---|---|---|
| Water | 50.00 | 50.00 | 50.00 | 50.00 | 50.00 |
| Citric Acid (50%) | 8.80 | 8.80 | 8.80 | 8.80 | 8.80 |
| Triethanolamine 99 LFG (85%) | 1.75 | 3.75 | 4.49 | 5.86 | 2.95 |
| Sodium Hydroxide (50%) | 5.59 | 5.59 | 5.59 | 5.59 | 5.59 |
| C12-C15 Alcohol Ethoxylate | 4.98 | 1.97 | 3.93 | 1.16 | 5.15 |
| Linear Alkylbenzene Sulfonate | 2.34 | 6.18 | 7.61 | 10.24 | 4.65 |
| Coconut Oil Fatty Acid | 0.50 | 0.50 | 0.50 | 0.50 | 0.50 |
| Alcohol Ethoxy Sulfate (60% Active) | 8.96 | 7.83 | 2.29 | 2.68 | 4.98 |
| Supracare 241 | 0.35 | 0.35 | 0.35 | 0.35 | 0.35 |
| Preservative | 0.09 | 0.09 | 0.09 | 0.09 | 0.09 |
| Water | 16.64 | 14.94 | 16.36 | 14.73 | 16.94 |
| Total | 100.00 | 100.00 | 100.00 | 100.00 | 100.00 |

The C12-C15 Alcohol Ethoxylate is a C12-C15 Alcohol Ethoxylate that is capped with approximately 7 moles of ethylene oxide.

Linear Alkylbenzene Sulfonate is 2-Phenyl Sulfonic Acid.

Alcohol Ethoxy Sulfate is Linear Alkylbenzene Sulfonate.

After formation, the Compositions 7-11 were used to machine wash Cotton 460 textiles. More specifically, samples of the textiles were washed and machine dried 3 times (24 gram dose each wash) in a standard toploader washer with 120 ppm hardness water, 0 ppm chlorine, and 90° F. temperature and 6 pounds of ballast. Fabrics were dried for 60 minutes in a standard machine dryer. Subsequently, each sample was evaluated to determine fabric softening using a Phabrometer 3, 16500 R1110, 5/12/2011 that is pre-programed with software. Values were determined after the third wash wherein a higher phabrometer value represents a better performing sample. The results are set forth in Table 6 below.

To determine anti-redeposition, 5 grams of Red Clay was added to each wash. These washes were independent from the aforementioned washes used to determine fabric softening. Again, samples of the textiles were washed except that Cotton 428 textiles were used. The textiles were then machine washed 3 times (24 gram dose each wash) in a standard toploader washer with 120 ppm hardness water, 0 ppm chlorine, and 90° F. temperature and 6 pounds of ballast. Fabrics were dried for 60 minutes in a standard machine dryer. Subsequently, each sample was evaluated to determine anti-redeposition of the red clay using a colorimeter such as an X-rite Ci 7860 instrument with Color iControl Program. Values were determined after the third wash. These washed fabrics were compared against an unwashed fabric. The delta E CMC values were then calculated for each sample vs. the unwashed fabric, wherein a higher delta E CMC represents a worse performing sample. The results are also set forth in Table 6 below. Each score is an average of 4 measurements on each fabric, for a total of 12 measurements on 3 different fabrics (that were washed together as triplicates within the same washing machine).

TABLE 6

| Composition | Delta E CMC for Anti-Redeposition Test After Wash 3 | Phabrometer Softening Score After Wash 3 |
|---|---|---|
| Composition 7 | 4.95 | 90.3495 |
| | 5.31 | 90.4013 |
| | 5.41 | 90.5325 |
| | — | 90.5341 |
| | — | 90.2414 |
| | — | 90.0581 |
| | — | 90.1741 |
| | — | 90.8177 |
| Average | 5.22 | 90.3886 |
| Composition 8 | 3.53 | 90.5051 |
| | 3.25 | 90.5756 |
| | 3.14 | 90.8538 |
| | — | 90.6969 |
| | — | 90.2976 |
| | — | 90.3669 |
| | — | 90.6200 |
| | — | 90.8392 |
| Average | 3.31 | 90.5944 |
| Composition 9 | 4.66 | 90.1732 |
| | 4.74 | 90.0709 |
| | 4.75 | 90.4314 |
| | — | 90.6237 |
| | — | 90.4427 |
| | — | 90.2993 |
| | — | 90.5494 |
| | — | 90.6127 |
| Average | 4.72 | 90.4004 |
| Composition 10 | 5.30 | 90.8444 |
| | 5.60 | 90.9405 |
| | 5.50 | 90.8929 |
| | — | 90.9567 |
| | — | 90.3296 |
| | — | 90.4265 |
| | — | 90.5561 |
| | — | 90.6710 |
| Average | 5.47 | 90.7022 |
| Composition 11 | 5.44 | 89.9303 |
| | 5.22 | 89.7751 |
| | 5.84 | 90.1164 |
| | — | 90.1309 |
| | — | 89.2776 |
| | — | 89.6876 |
| | — | 89.2002 |
| | — | 89.9601 |
| Average | 5.50 | 89.7598 |

Using JMP statistical software, a predictive expression was then determined to predict the softness and anti-redeposition values for any ratio of surfactants.

The following predictive expression was created for anti-redeposition values:

$$7.5932795555024*NI+3.68947385553*AES+5.09799576797941*LAS$$

wherein LAS is linear alkylbenzene sulfonate, NI is the C12-C15 Alcohol Ethoxylate, and AES is the alcohol ethoxy sulfate. The predictive expression shows the C12-C15 Alcohol Ethoxylate has the worst impact on anti-redeposition performance vs. the alcohol ethoxy sulfate/linear alkylbenzene sulfonate.

The following predictive expression was created for softness values:

$$7.89583618214*NI+3.68944473855558*AES+5.09799576797941*LAS$$

wherein LAS is linear alkylbenzene sulfonate, NI is the C12-C15 Alcohol Ethoxylate, and AES is the alcohol ethoxy sulfate. The predictive expression shows the linear alkylbenzene sulfonate and the alcohol ethoxy sulfate have the best effect of softening (higher score is preferred). The C12-C15 Alcohol Ethoxylate had the worst impact on softening performance.

Example 3

Based on the results of Example 2, the following Design of Experiment was created for a liquid laundry detergent system, wherein particular alcohol ethoxy sulfate and C12-C15 alcohol ethoxylate regions of the ternary plot of FIG. 2 were removed from consideration based on their poor performance in Example 1. As first described above, these removed sections are those shown in the ternary plot of FIG. 4 as shaded.

Compositions 8, 12, and 13, also first described above, were evaluated along with a Control Composition. Each of these Compositions are set forth in Table 7 below:

TABLE 7

| | Control Composition | Comp. 8 | Comp. 12 | Comp. 13 |
|---|---|---|---|---|
| Water | 50.00 | 50.00 | 50.00 | 50.00 |
| Citric Acid (50%) | 8.80 | 8.80 | 8.80 | 8.80 |
| Triethanolamine 99 LFG (85%) | 1.48 | 3.75 | 4.29 | 1.48 |
| Sodium Hydroxide (50%) | 5.59 | 5.59 | 5.59 | 5.59 |
| C12-C15 Alcohol Ethoxylate | 6.80 | 1.97 | 0.00 | 6.83 |
| Linear Alkylbenzene Sulfonate | 1.82 | 6.18 | 7.22 | 1.83 |
| Coconut Oil Fatty Acid | 0.50 | 0.50 | 0.50 | 0.50 |
| Alcohol Ethoxy Sulfate (60% Active) | 6.67 | 7.83 | 9.45 | 6.69 |
| Supracare 241 | — | 0.35 | 0.35 | 0.35 |
| Preservative | 0.09 | 0.09 | 0.09 | 0.09 |
| Water | 18.24 | 14.94 | 13.71 | 17.83 |
| Total | 100.00 | 100.00 | 100.00 | 100.00 |

After formation, the Compositions 8, 12, and 13, along with the Control Composition, were used to machine wash Terry 100% cotton towels. More specifically, samples of the Terry 100% cotton towels were washed and machine dried 5 times (55.7 gram dose each wash) in a standard toploader washer with 120 ppm hardness water, 0 ppm chlorine, and 90° F. temperature and 6 pounds of ballast. The Terry 100% cotton towels were dried for 60 minutes in a standard machine dryer. Subsequently, each sample was evaluated to determine fabric softening by a trained panel of evaluators using a 0-10 tactile scale wherein 0 represented being not soft and 10 represented maximum softness. The samples were labeled with 3 digit codes so the panelists were blinded and unbiased.

The average score across the 10 panelists for Composition 8 was 4.8; for Composition 13 was 4; and for the Control Composition was 3.4. Samples were determined to be statistically different from one another (using a Tukey test), with Composition 13 being statistically softer than the Control Composition and Composition 8 being statistically even softer than Composition 13.

To determine anti-redeposition, 5 grams of Red Clay was added to each wash. These washes were independent from the aforementioned washes used to determine fabric softening. Again, samples of the textiles were washed except that Cotton 428 textiles were used. The textiles were then machine washed 3 times (24 gram dose each wash) in a standard toploader washer with 120 ppm hardness water, 0 ppm chlorine, and 90° F. temperature and 6 pounds of ballast. Fabrics were dried for 60 minutes in a standard machine dryer. Subsequently, each sample was evaluated to determine anti-redeposition of the red clay using a colorimeter such as an X-rite Ci 7860 instrument with Color iControl Program. Values were determined after the third wash. These washed fabrics were compared against an unwashed fabric. The delta E CMC values were then calculated for each sample vs. the unwashed fabric, wherein a higher delta E CMC represents a worse performing sample. The results are also set forth in Table 8 below. Each score is an average of 4 measurements on each fabric, for a total of 12 measurements on 3 different fabrics (that were washed together as triplicates within the same washing machine).

TABLE 8

| | Delta E CMC for Anti-Redeposition Test After Wash 1 | Delta E CMC for Anti-Redeposition Test After Wash 3 | Delta E CMC for Anti-Redeposition Test After Wash 5 |
|---|---|---|---|
| Control | 0.60 | 2.71 | 3.95 |
| Composition | 1.04 | 2.87 | 3.33 |
| | 1.05 | 2.72 | 3.28 |
| Average | 0.90 | 2.77 | 3.52 |
| Composition 8 | 2.75 | 5.43 | 7.23 |
| | 2.30 | 6.02 | 7.27 |
| | 2.71 | 5.57 | 6.62 |
| Average | 2.59 | 5.67 | 7.04 |
| Composition 12 | 2.68 | 5.23 | 6.98 |
| | 2.46 | 5.32 | 6.95 |
| | 2.34 | 4.91 | 6.43 |
| Average | 2.49 | 5.15 | 6.79 |
| Composition 13 | 2.90 | 6.73 | 8.61 |
| | 3.26 | 6.50 | 8.87 |
| | 3.43 | 6.58 | 8.53 |
| Average | 3.20 | 6.60 | 8.67 |

After 5 washes, the average delta E CMC score of Composition 8 was approximately 1.63 units improved over (i.e., less than) the average delta E CMC unit score of Composition 13 which is significant and perceivable by the naked eye, wherein those of skill in the art appreciate that the naked eye can distinguish color differences that are over a 1 delta E CMC unit difference.

Without being bound by theory, it is believed that systems that are higher in LAS (and secondary AES) and lower in Alcohol Ethoxylate generally provide a higher degree of softening and a lower redeposition score (both favorable) as shown on FIG. 3, based on the JMP equation models.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A detergent composition for improved textile softening and anti-redeposition, said composition comprising:

A. a surfactant component comprising;

(1) an alcohol ethoxy sulfate having a $C_8$-$C_{20}$ backbone that is ethoxylated with from about 1 to about 10 moles of ethylene oxide;

(2) at least one non-ionic surfactant comprising an alkoxylated alcohol; and (3) at least one anionic surfactant comprising a linear alkylbenzene sulfonate;

B. water present in a total amount of from about 10 to about 85 weight percent based on a total weight of said detergent composition; and C. a cationic polymer present in an amount of from about 0.05 to about 1 weight percent actives based on a total weight of said detergent compositions;

wherein the weight ratio of actives of (1), (2), and (3) falls within a five-sided region (A) of a ternary plot, wherein the five-sided region (A) is defined by five points of the ratio of (1):(2):(3) as follows:

(i) (0.55):(0):(0.45);

(ii) (0.25):(0.3):(0.45);

(iii) (0):(0.3):(0.7);

(iv) (0):(0.1):(0.9);

(v) (0.1):(0):(0.9); or wherein the weight ratio of actives of (1), (2), and (3) falls within a three-sided region (B) of a ternary plot, wherein the three-sided region (B) is defined by three points of the ratio of (1):(2):(3) as follows:

(vi) (0):(0.55):(0.45);

(vii) (0.25):(0.3):(0.45); and (viii) (0):(0.3):(0.7).

2. The detergent composition of claim 1 wherein the weight ratio of actives of (1), (2), and (3) are: (0.40):(0.43):(0.18).

3. The detergent composition of claim 1 wherein the weight ratio of actives of (1), (2), and (3) are: (0.16):(0.37):(0.47).

4. The detergent composition of claim 1 wherein the weight ratio of actives of (1), (2), and (3) are: (0.31):(0.11):(0.58).

5. The detergent composition of claim 1 wherein the weight ratio of actives of (1), (2), and (3) are: (0.09):(0.13):(0.78).

6. The detergent composition of claim 1 wherein the weight ratio of actives of (1), (2), and (3) are: (0.41):(0.24):(0.35).

7. The detergent composition of claim 1 wherein the weight ratio of actives of (1), (2), and (3) are: (0):(0.45):(0.55).

8. The detergent composition of claim 1 wherein said cationic polymer is present in an amount of from about 0.1 to about 0.5 weight percent actives based on a total weight of said detergent composition.

9. The detergent composition of claim 1 wherein said water is present in an amount of from about 10 to 20 weight percent based on a total weight of said detergent composition.

10. The detergent composition of claim 1 wherein said water is present in an amount of from about 20 to 85 weight percent based on a total weight of said detergent composition.

11. The detergent composition of claim 1 wherein said alcohol ethoxy sulfate is sodium laureth sulfate ethoxylated with about 2 to about 4 moles of ethylene oxide, said linear alkyl benzenesulfonate has a linear alkyl chain that has from about 10 to about 13 carbon atoms, and said alkoxylated alcohol is an ethoxylated alcohol comprising a $C_8$-$C_{20}$ backbone that is ethoxylated with from about 2 to about 12 moles of ethylene oxide.

12. The detergent composition of claim 1 wherein said cationic polymer is chosen from polydiallyldimethylammonium chloride/acrylamide copolymers, a copolymer of ((2-methacryloyloxy)ethyl)-trimethyl ammonium chloride, cationic cellulosic polymers, and combinations thereof.

13. The detergent composition of claim 1, wherein said (1) alcohol ethoxy sulfate is sodium laureth sulfate ethoxylated with about 2 to about 4 moles of ethylene oxide, said (2) alkoxylated alcohol is a C12-C15 alcohol ethoxylate that is capped with approximately 7 moles of ethylene oxide; and said (3) linear alkyl benzenesulfonate is 2-Phenyl Sulfonic Acid, and wherein the weight ratio of actives of (1), (2), and (3) falls within a five-sided region (A) of a ternary plot, wherein the five-sided region (A) is defined by five points of the ratio of (1):(2):(3) as follows:

(i) (0.55):(0):(0.45);

(ii) (0.25):(0.3):(0.45);

(iii) (0):(0.3):(0.7);

(iv) (0):(0.1):(0.9);

(v) (0.1):(0):(0.9).

14. The detergent composition of claim 1, wherein said (1) alcohol ethoxy sulfate is sodium laureth sulfate ethoxylated with about 2 to about 4 moles of ethylene oxide, said (2) alkoxylated alcohol is a C12-C15 alcohol ethoxylate that is capped with approximately 7 moles of ethylene oxide; and said (3) linear alkyl benzenesulfonate is 2-Phenyl Sulfonic Acid, and wherein the weight ratio of actives of (1), (2), and (3) falls within a three-sided region (B) of a ternary plot, wherein the three-sided region (A) is defined by three points of the ratio of (1):(2):(3) as follows:

(vi) (0):(0.55):(0.45);

(vii) (0.25):(0.3):(0.45); and (viii) (0):(0.3):(0.7).

15. A unit dose detergent pack comprising a pouch made of a water-soluble film and the detergent composition of claim 1 encapsulated within said pouch, wherein said water is present in an amount of from about 10 to 20 weight percent based on a total weight of said detergent composition.

16. A method of washing a textile to provide improved cleaning, anti-deposition, and/or softening benefits in the presence of a clay, wherein said method comprises the step of providing a textile optionally soiled with clay;

providing water comprising the detergent composition of claim 1 and optionally clay; and washing the textile with the water and the detergent composition, and wherein at least one of the textile or the water comprises the clay.

17. The method of claim 16 wherein the weight ratio of actives of (1), (2), and (3) falls within a five-sided region (A) of a ternary plot, wherein the five-sided region (A) is defined by five points of the ratio of (1):(2):(3) as follows:

(i) (0.55):(0):(0.45);

(ii) (0.25):(0.3):(0.45);

(iii) (0):(0.3):(0.7);

(iv) (0):(0.1):(0.9);

(v) (0.1):(0):(0.9).

18. The method of claim 16 wherein the weight ratio of actives of (1), (2), and (3) falls within a three-sided region (B) of a ternary plot, wherein the three-sided region (B) is defined by three points of the ratio of (1):(2):(3) as follows:

(vi) (0):(0.55):(0.45);

(vii) (0.25):(0.3):(0.45); and (viii) (0):(0.3):(0.7).

* * * * *